US005401162A

United States Patent [19]

Bonne

[11] Patent Number: 5,401,162

[45] Date of Patent: Mar. 28, 1995

[54] MICROBRIDGE-BASED COMBUSTION CONTROL

[75] Inventor: Ulrich Bonne, Hopkins, Minn.

[73] Assignee: Honeywell Inc., Minneapolis, Minn.

[21] Appl. No.: 789,411

[22] Filed: Nov. 1, 1991

Related U.S. Application Data

[63] Continuation of Ser. No. 429,138, Oct. 30, 1989, abandoned.

[51] Int. Cl.[6] ..... F23N 5/00

[52] U.S. Cl. ..... 431/12; 431/89; 431/90

[58] Field of Search ..... 431/12, 89, 90

[56] References Cited

U.S. PATENT DOCUMENTS

| | | | |
|---|---|---|---|
| 3,722,811 | 3/1973 | Osburn | 431/12 |
| 4,054,408 | 10/1977 | Sheffield et al. | 431/12 |
| 4,138,725 | 2/1979 | Ikemoto et al. | 431/76 X |
| 4,459,098 | 7/1984 | Turek et al. | 431/12 |
| 4,493,635 | 1/1985 | Ito et al. | 431/90 |
| 4,498,863 | 2/1985 | Hanson et al. | 431/90 X |
| 4,557,686 | 12/1985 | LaSpisa | 431/90 X |
| 4,576,570 | 3/1986 | Adams et al. | 431/12 |
| 4,659,306 | 4/1987 | Altemark et al. | 431/12 |
| 4,798,531 | 1/1989 | Breckner | 431/12 |
| 4,956,793 | 9/1990 | Bonne et al. | 73/30.01 X |

FOREIGN PATENT DOCUMENTS 0181783 5/1986 European Pat. Off. .

*Primary Examiner*—Carroll B. Dority

*Attorney, Agent, or Firm*—John G. Shudy, Jr.; Michael B. Atlass

[57] ABSTRACT

In a combustion system, fuel flow and fuel composition are sensed, and energy flow in the combustion system is determined based on the fuel flow and the fuel composition. Air flow of combustion air is also sensed. The fuel-to-air ratio in the combustion system is controlled as a function of the energy or oxygen demand flow determined and the air flow sensed.

37 Claims, 1 Drawing Sheet

MICROBRIDGE-BASED COMBUSTION CONTROL

This is a continuation of application Ser. No. 07/429,138, filed on Oct. 30, 1989, and now abandoned.

BACKGROUND OF THE INVENTION

1. Incorporation by Reference

The following commonly assigned applications are co-pending with this application and are hereby incorporated by reference:

Ser. No. 210,892, filed Jun. 24, 1988 "MEASUREMENT OF THERMAL CONDUCTIVITY AND SPECIFIC HEAT", U.S. Pat. No. 4,944,035; Ser. No. 211,014, filed Jun. 24, 1988, entitled "MEASUREMENT OF FLUID DENSITY", U.S. Pat. No. 4,956,793.

Ser. No. 285,897, filed Dec. 16, 1988 entitled entitled "FLOWMETER FLUID COMPOSITION CORRECTION", U.S. Pat. No. 4,961,348; Ser. No. 285,890, filed Dec. 16, 1988 entitled "LAMINARIZED FLOWMETER" abandoned.

2. Field of the Invention

The present invention relates to controlling the combustion process for a heating system. More particularly, the present invention relates to controlling a fuel-to-air ratio of that combustion process.

3. Description of the Prior Art

There are many applications for industrial and commercial heating systems such as ovens, boilers and burners. These heating systems are generally controlled by some type of control system which operates fuel valves and air dampers to control the fuel-to-air ratio which enters the heating system. It is generally desirable to sense the fuel-to-air ratio to achieve a desired combustion quality and energy efficiency.

Conventional sensing of the fuel-to-air ratio has taken two forms. The first form includes sensing the concentration of carbon dioxide or oxygen in flue gases. This method of sensing the proper fuel-to-air ratio is based on an intensive measurement of the flue gases. However, in practice, this method has encountered problems of reliability due to inaccuracy in the sensors which are exposed to the flue gases. Problems related to response time of the sensors have also been encountered. The system cannot sense the carbon dioxide and oxygen components of the flue gasses and compute the fuel-to-air ratio quickly enough for the fuel and air flow to be accurately adjusted.

The second form includes monitoring the flow rate of the fuel and air as it enters the burner. This method leads to a desirable feed-forward control system. However, until now, only flow rate sensors have been involved in this type of monitoring system. Therefore, the system has been unable to compensate for changes in air humidity or fuel composition.

SUMMARY OF THE INVENTION

The present method is responsive to a need to control a fuel-to-air ratio in a combustion heating system based on fuel composition to achieve a desired combustion and energy efficiency. Fuel flow and air flow are sensed in the combustion system. Fuel composition is also sensed. Energy or oxygen demand flow to the combustion system is determined based on the fuel flow and the fuel composition. The fuel-to-air ratio is controlled as a function of the energy or oxygen demand flow determined and the air or oxygen supply flow sensed.

DETAILED DESCRIPTION OF THE PREFERRED EMBODIMENTS

Figure 1:
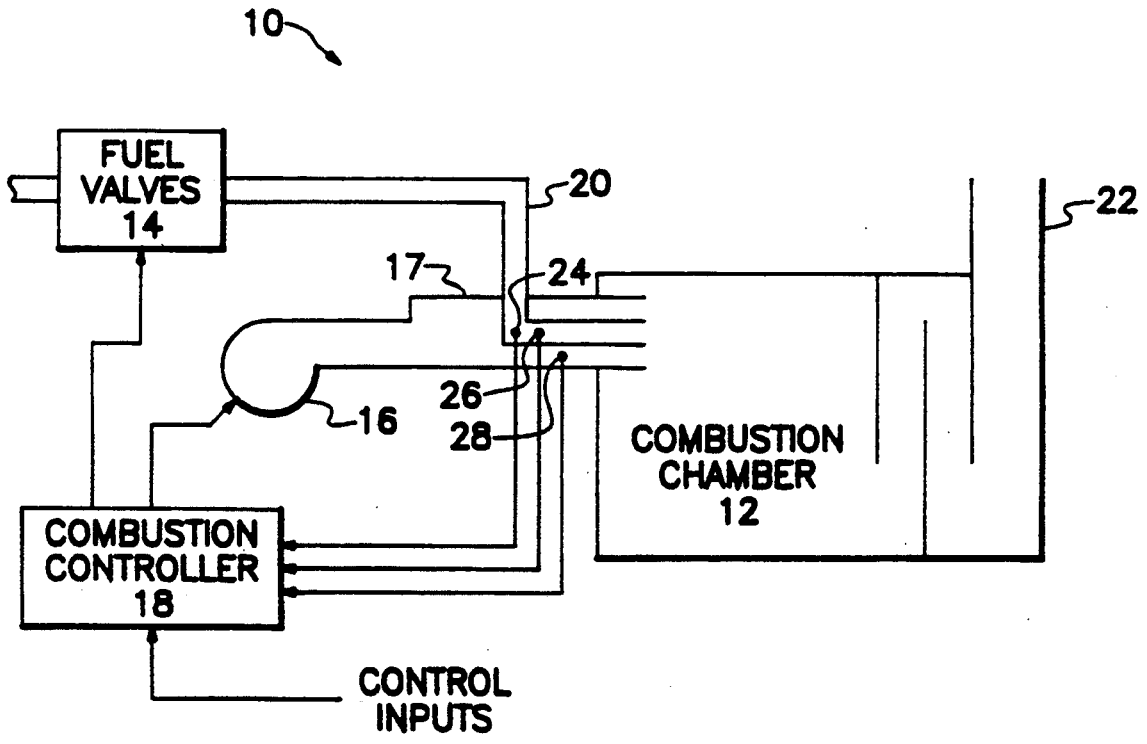
FIG. 1 is a block diagram of a heating system.

FIG. 1 shows a block diagram of heating system 10. Heating system 10 is comprised of combustion chamber 12, fuel valves 14, air blower 16 and combustion controller 18. Fuel enters combustion chamber 12 through fuel conduit 20 where it is combined with air blown from air blower 16. The fuel and air mixture is ignited in combustion chamber 12 and resulting flue gases exit combustion chamber 12 through flue 22.

Combustion controller 18 controls the fuel-to-air mixture in combustion chamber 12 by opening and closing fuel valves 14 and by opening and closing air dampers in air conduit 17. Combustion controller 18 controls the fuel-to-air mixture based on control inputs entered by a heating system operator as well as sensor inputs received from sensors 24 and 26 in fuel conduit 20, and sensor 28 in air conduit 17.

Sensors 24, 26 and 28 are typically microbridge or microanemometer sensors which communicate with flowing fuel in fuel conduit 20 and flowing air in air conduit 17. This type of sensor is described in more detail in co-pending, related application Ser. No. 285,890, filed on Dec. 16, 1988 and now abandoned and assigned to the common assignee of the present application.

Sensors 24 and 28 are directly exposed to the stream of fluid flowing past them in conduits 20 and 17, respectively. Sensors 24 and 28 are used to directly measure dynamic fluid flow characteristics of the respective fluids.

Microbridge sensor 26 enables other parameters of the fuel to be measured simultaneously with the dynamic flow. Sensor 26 can be used for the direct measurement of thermal conductivity, k, and specific heat, $c_p$, in accordance with a technique which allows the accurate determination of both properties. That technique contemplates generating an energy or temperature pulse in one or more heater elements disposed in and closely coupled to the fluid medium in conduit 20. Characteristic values of k and $c_p$ of the fluid in conduit 20 then cause corresponding changes in the time variable temperature response of the heater to the temperature pulse. Under relatively static fluid flow conditions this, in turn, induces corresponding changes in the time variable response of more temperature responsive sensors coupled to the heater principally via the fluid medium in conduit 20.

The thermal pulse need be only of sufficient duration that the heater achieve a substantially steady-state temperature for a short time. Such a system of determining thermal conductivity, k, and specific heat, $c_p$, is described in greater detail in co-pending applications Ser. No. 285,897, filed Dec. 16, 1988, now U.S. Pat. No. 4,961,348, and Ser. No. 210,892, filed Jun. 24, 1988, now U.S. Pat. No. 4,944,035, and assigned the same assignee as the present application.

It has also been found that once the specific heat and thermal conductivity of the fluid have been determined, they can be used to determine the density or specific gravity of the fluid. This technique is more specifically illustrated and described in patent application, Ser. No.

211,014, also filed Jun. 24, 1988, now U.S. Pat. No. 4,956,793, and assigned to the same assignee as in the present application. Of course, these parameters can be determined by other means if such are desirable in other applications.

Once k and $c_p$ are known, shift correction factors in the form of simple, constant factors for the fuel can be calculated. The shift correction factors have been found to equilibrate mass or volumetric flow measurements with sensor outputs. In other words, once k and $c_p$ of the fuel gas is known, its true volumetric, mass and energy flows can be determined via the corrections:

$$S^*=S(k/k_0)^m(c_p/c_{p0})^n \quad \text{Eq. 1}$$

$$V^*=V(k/k_0)^p(C_p/C_{p0})^q \quad \text{Eq. 2}$$

$$M^*=M(k/k_0)^r(c_p/c_{p0})^s \quad \text{Eq. 3}$$

$$E^*=E(k/k_0)^t(c_p/c_{p0})^u \quad \text{Eq. 4}$$

Where the subscript "0" refers to a reference gas such as methane and the m, n, p, q, r, s, t and u are exponents; and where S* equals the corrected value of the sensor signal S, V* equals the corrected value for the volumetric flow V, M* equals the corrected value for the mass flow, and E* equals the corrected value for the energy flow, E.

This technique of correcting the sensor signal, the mass flow, the volumetric flow and the energy flow is explained in greater detail in co-pending patent application Ser. No. 285,897, filed on Dec. 16, 1988, now U.S. Pat. No. 4,961,348, and assigned to the common assignee of the present application.

It has been found that several groups of natural gas properties lend themselves to advantageous determination of heating value for the gas. One of these groups is thermal conductivity and specific heat. The heating value, H, is determined by a correlation between the physical, measurable natural gas properties and the heating value.

Since thermal conductivity, k, and specific heat, $c_p$, have been determined for the fuel flowing through conduit 20, the heating value, H, of the fuel flowing through conduit 20 can be determined. By evaluating the polynomial $$H=A_1f_1^{n1}(x)\cdot A_2f_2^{n2}(x)\cdot A_3f_3^{n3}(x) \quad \text{Eq. 5}$$

for a selection of over 60 natural gasses, the following were obtained:

$A_1=9933756$ $f_1(x)=k_c$(thermal conductivity at a first temperature)

$n1=-2.7401.$ $A_2=1,$ $f_2(x)=k_h$(thermal conductivity at a second, higher temperature)

$n2=3.4684,$ $A_3=1,$ $f_3(x)=Cp$ (specific heat), and $n3=1.66326$

The maximum error in the heating value calculation=2.26 btu/ft$^3$ and the standard error for the heating value calculation=0.654 btu/ft$^3$.

Alternatively, the heating value of the fluid in conduit 20 could be calculated by evaluating the polynomial of equation 5 using the following values:

$A_1=10017460,$ $f_1(x)=kc$ (the thermal conductivity at a first temperature), $n1=-2.6793,$ $A_2=1,$ $f_2(x)=k_h$(thermal conductivity at a second, higher temperature), $2n2=3.3887,$ $A_3=1,$ $f_3(x)=C_p$(specific heat) and $n3=1.65151.$ For these values, the maximum error in the calculation of heating value, H, equals 1.82 btu/ft$^3$ and the standard error equals 0.766 btu/ft$^3$.

It should be noted that, although equation 5 only uses thermal conductivity and specific heat to calculate the heating value, other fuel characteristics can be measured, such as specific gravity and optical absorption, and other techniques or polynomials can be used in evaluating the heating value of the fluid in conduit 20.

Having determined the volumetric or mass flow for the fluid in conduit 20 and for the air in conduit 17, and having determined the heating value of the fuel in conduit 20, energy flow (or btu flow) can be determined by the following equation.

$$E=H_vV=H_mM \quad \text{Eq. 6}$$

where $H_v$=the heating value in btu's per unit volume, $H_m$=heating value in btu per unit mass, V=volumetric flow of the fuel, and M=mass flow of the fuel.

By using the corrected value of the volumetric or mass flow (V* or M*) of the fuel in conduit 20, the correct energy flow in btu/second flowing through conduit 20 can be determined.

Based on the energy flow through conduit 20 and the corrected mass or volumetric flow of air through conduit 17, the fuel flow or air flow can be adjusted to achieve a desired mixture.

A well known property of hydrocarbon-type fuels is that hydrocarbons combine with oxygen under a constant (hydrocarbon-independent) rate of heat release. The heat released by combustion is 100 btu/ft$^3$ of air at 760 mmHg and 20° C. or (68° F.). This is exactly true for fuel with an atomic hydrogen/carbon ratio of 2.8 and a heating value of 21300 btu/lb of combustibles and is true to within an error of less than +/− 0.20% for other hydrocarbons from methane to propane (i.e. $CH_4$, $C_2H_6$ and n-$C_3H_8$).

With this knowledge, combustion control can now be designed such that gaseous hydrocarbon fuels (the fuel through conduit 20) is provided to combustion chamber 12 in any desired proportions with air.

For example, in order to achieve stoichiometric (zero excess air) combustion, the mixture would be one cubic foot of air for each 100 btu of fuel (e.g. 0.1 cubic foot of $CH_4$). A more typical mix would be 10% to 30% excess air which would require 1.1 to 1.3 cubic feet of air for each 100 btu of fuel. This would be a typical mixture because residential appliances typically operate in the 40–100% excess air range while most commercial combustion units operate between 10 and 50% excess air.

Although the present invention has been described with reference to fuels with hydrocarbon constituents, the fuel-to-air ratio in combustion heating system 10 can also be controlled when heating system 10 uses other fuels. Each fuel used in combustion requires or demands a certain amount of oxygen for complete and efficient combustion (i.e., little or no fuel or oxygen remaining after combustion). The amount of oxygen required by each fuel is called the oxygen demand value $D_f$ for that fuel. $D_f$ is defined as units of moles of $O_2$ needed by each mole of fuel for complete combustion. For example, the $O_2$ demand for $CH_4$, $C_2H_6$, $C_3H_8$, CO, $H_2$ and $N_2$ is $D_f$=2, 3.5, 5.0, 0.5, 0.5 and 0 respectively.

Air is used to supply the oxygen demand of the fuel during combustion. In other words, fuel is an oxygen consumer and air is an oxygen supplier or donator during combustion. The $O_2$ donation, $D_o$, is defined as the number of moles of $O_2$ provided by each mole of air. The single largest factor which influences $D_o$ is the humidity content of the air. Absolutely dry air has a value of $D_o$=0.209, while normal room temperature air with 30% relative humidity (or 1% mole fraction of $H_2O$) has a value of $D_o$=0.207.

With the addition of microbridge sensor 30 to heating system 10, various components of the air in conduit 17 can be sensed. For example, oxygen content, $D_o$, can be sensed and the presence of moisture (i.e., humidity) can be accounted for. By knowing these and other components of the air, (i.e., the composition of the air) in conduit 17, the fuel-to-air ratio in heating system 10 can be controlled to achieve even more precise combustion control.

Therefore, combustion control can be accomplished by correlating the sensed k and $c_p$ of the fuel to the oxygen demand $D_f$ value rather than heating value of the fuel. Once the oxygen demand value of the fuel is known, the fuel-to-air ratio can be accurately controlled. By using the oxygen demand value of the fuel rather than the heating value, the fuel-to-air ratio of fuels with constituents other than hydrocarbons can be accurately controlled.

It should also be noted that, with the addition of microbridge sensor 30 in conduit 17, the corrected mass or volumetric flow for the air in conduit 17 can be determined in the same manner as the corrected mass or volumetric flow for the fuel is determined above. This further increases the accuracy of fuel-to-air ratio control.

CONCLUSION

The present invention allows the fuel-to-air ratio in a heating system to be controlled based not only on the flow rates of the fuel and air but also on the composition of the fuel and air used in the heating system. Hence, the present invention provides the ability to reset the desired fuel and air flow rates so that a fuel-to-air ratio is achieved which maintains desirable combustion efficiency and cleanliness conditions (such as low level of undesirable flue gas constituents and emissions like soot, CO or unburned hydrocarbons).

Further, the present invention provides greater reliability and response time over systems where sensors were exposed to flue gases. Also, the present invention provides compensation for changes in fuel and air composition while still providing a desirable feed-forward control.

In addition, this invention is well suited for use in a multi-burner composition chamber. If used, each burner would be individually adjustable.

Although the present invention has been described with reference to preferred embodiments, workers skilled in the art will recognize that changes may be made in form and detail without departing from the spirit and scope of the invention.

What is claimed is:

1. A method of controlling a fuel-to-air ratio in a combustion system, comprising:

sensing fuel flow rate in the combustion system;

sensing parameters representative of the composition of the fuel in the combustion system, including at least one parameter selected from thermal conductivity and specific heat;

determining average fuel composition based on the sensed parameters;

determining energy flow in the combustion system based on the fuel flow rate and the average fuel composition;

sensing combustion air flow rate in the combustion system; and controlling the fuel-to-air ratio as a function of the energy flow determined and the air flow sensed.

2. The method of claim 1 wherein the step of determining average fuel composition further comprises:

determining a heating value of the fuel.

3. The method of claim 2 wherein the step of determining a heating value further comprises:

sensing thermal conductivity of the fuel;

sensing specific heat of the fuel; and determining the heating value of the fuel based on the thermal conductivity and the specific heat of the fuel.

4. The method of claim 3 including the step of sensing the thermal conductivity of the fuel at a plurality of temperatures.

5. The method of claim 4, wherein the heating value determining step comprises:

receiving from a sensor in the fuel flow stream a data signal encoding first and second thermal conductivity values $f_1(x)$ and $f_2(x)$ respectively of at least a first gaseous fuel at first and second different temperatures respectively;

recording the first and second thermal conductivity values;

receiving from a sensor in the fuel flow stream a data signal encoding a :specific heat value $f_3(x)$ of at least the first gaseous fuel;

recording the specific heat value;

receiving a data signal encoding polynomial coefficient values $A_1$, $A_2$, $A_3$, and exponent values n1, n2, and n3;

recording the polynomial coefficient values;

retrieving the recorded first and second thermal conductivity values, the specific heat value, and the polynomial coefficient values and computing the heating value $H=A_1f_1^{n1}(x)\cdot A_2f_2^{n2}(x)\cdot A_3f_3^{n3}(x)$; and recording the heating value H.

6. The method of claim 1 wherein the step of sensing fuel flow further comprises:

sensing volumetric flow of the fuel;

determining correction factors for the volumetric flow based on sensed parameters including specific heat and thermal conductivity; and determining a corrected volumetric flow for the fuel based on the correction factors and the sensed volumetric flow.

7. The method of claim 1 wherein the step of sensing fuel flow further comprises:

sensing mass flow of the fuel;

determining correction factors for the mass flow based on sensed parameters including specific heat and thermal conductivity; and determining a corrected mass flow for the fuel based on the correction factors and the sensed mass flow.

8. The method of claim 1 wherein the step of sensing combustion air flow further comprises:

sensing volumetric flow of the combustion air;

determining correction factors for the volumetric flow for the combustion air based on sensed parameters including specific heat and thermal conductivity; and determining a corrected volumetric flow for the air based on the correction factors and the sensed volumetric flow.

9. The method of claim 1 wherein the step of sensing combustion air flow further comprises:

sensing mass flow of the combustion air;

determining correction factors for the mass combustion air flow based on sensed parameters including specific heat and thermal conductivity; and determining a corrected mass flow for the combustion air based on the correction factors and the sensed mass flow.

10. A method of controlling the fuel-to-air ratio in a combustion system, comprising:

selecting a desired fuel-to-air flow ratio set point;

sensing fuel flow and air flow to the combustion system;

sensing parameters representative of composition of the fuel supplied to the combustion system, including at least one selected from thermal conductivity and specific heat parameters of the fuel;

determining average fuel composition as related to heating value based on the sensed parameters;

determining energy flow in the combustion system based on the fuel flow and the average fuel composition; and controlling the fuel-to-air ratio as a function of the energy flow determined and sensing the air flow to the combustion system.

11. The method of claim 9 wherein the combustion system is a heating system.

12. The method of claim 10 wherein the step of selecting a desired fuel-to-air flow ratio further comprises:

setting a fuel flow rate in the combustion system; and setting an air flow rate in the combustion system.

13. The method of claim 12 wherein the step of controlling the desired fuel-to-air flow ratio further comprises:

resetting the fuel flow rate based on the energy flow determined.

14. The method of claim 12 wherein the step of controlling the desired fuel-to-air flow ratio further comprises:

resetting the air flow rate based on the oxygen demand of the energy flow determined.

15. The method of claim 12 wherein the step of setting a fuel flow rate further comprises:

setting a volumetric flow rate of the fuel.

16. The method of claim 12 wherein the step of setting a fuel flow rate further comprises:

setting a mass flow rate of the fuel.

17. The method of claim 15 wherein the step of setting an air flow rate further comprises:

setting a volumetric flow rate of the combustion air.

18. The method of claim 16 wherein the step of setting an air flow rate further comprises:

setting a mass flow rate of the combustion air.

19. An apparatus for controlling a fuel-to-air ratio in a heating system, comprising:

flow sensing means for sensing the rate of fuel flow in the heating system;

composition sensing means for sensing parameters representative of composition of the fuel in the heating system, including means for sensing at least one of the parameters selected from thermal conductivity and specific heat of the fuel;

composition determining means for determining average fuel composition based on the sensed parameters;

flow determining means for determining energy flow in the heating system based on the fuel flow and the average fuel composition;

air flow sensing means sensing combustion air flow in the heating system; and control means controlling the fuel-to-air ratio as a function of the energy flow determined and the combustion air flow sensed.

20. The apparatus of claim 19 wherein the composition determining means further comprises:

heating value determining means for determining a heating value of the fuel, the heating value determining means further comprising;

thermal conductivity sensing means for sensing thermal conductivity of the fuel;

specific heat sensing means for sensing specific heat of the fuel; and value determining means for determining the heating value of the fuel based on the thermal conductivity and the specific heat of the fuel;

means for receiving from the composition sensing means a data signal encoding first and second thermal conductivity values $f_1(x)$ and $f_2(x)$ respectively of at least a first gaseous fuel at first and second different temperatures respectively, and for recording the thermal conductivity values and for providing the thermal conductivity values in a digital signal;

means for receiving from the composition sensing means a data signal encoding the specific heat value $f_3(x)$ of at least the first gaseous fuel, and for recording the specific heat value and for providing the specific heat values in a digital signal;

means for receiving a data signal encoding polynomial coefficients $A_1$, $A_2$, $A_3$, and exponent values n1, n2, and n3, and for recording these polynomial coefficient values and for providing the polynomial coefficients in a digital signal; and computing means receiving the digital signals from the date signal receiving means for calculating the heat value H for the fuel equal to $A_1f_1^{n1}(x)\cdot A_2f_2^{n2}(x)\cdot A_3f_3^{n3}(x)$, and for providing a digital signal encoding the most recently calculated value of H.

21. An apparatus for controlling a fuel-to-air ratio in a combustion system, comprising:

fuel flow sensing means for sensing fuel flow in the combustion system;

parameter sensing means for sensing parameters representative of the oxygen demand value of the fuel in the combustion system including at least one of the parameters selected from thermal conductivity and specific heat of the fuel;

determining means for determining the oxygen demand value based on the sensed parameters;

combustion air flow sensing means sensing air flow of combustion air in the combustion system; and control means for controlling the fuel-to-air ratio as a function of the fuel flow, the oxygen demand value of the fuel and the air flow sensed.

22. The apparatus of claim 21 wherein the fuel flow sensing means further comprises:

volumetric sensing means for sensing volumetric flow of the fuel;

correction means for determining correction factors for the volumetric flow based on specific heat and thermal conductivity; and flow correction means for determining a corrected volumetric flow for the fuel based on the correction factors and the sensed volumetric flow.

23. The apparatus of claim 21 wherein the fuel flow sensing means further comprises:

mass flow sensing means for sensing mass flow of the fuel;

correction means for determining correction factors for the mass flow based on specific heat and thermal conductivity; and mass flow correction means for determining a corrected mass flow for the fuel based on the correction factors and the sensed mass flow.

24. The apparatus of claim 21 wherein the air flow sensing means further comprises:

volumetric flow sensing means for sensing volumetric flow of the combustion air;

correction means for determining correction factors for the volumetric combustion air flow based on specific heat and thermal conductivity; and volumetric flow correction means for determining a corrected volumetric flow for the air based on the correction factors and the sensed volumetric flow.

25. The apparatus of claim 21 wherein the air flow sensing means further comprises:

mass flow sensing means for sensing mass flow of the combustion air;

correction means for determining correction factors for the mass flow of combustion air based on specific heat and thermal conductivity; and mass flow correction means for determining a corrected mass flow for the combustion air based on the correction factors and the sensed mass flow.

26. A method of controlling a fuel-to-air ratio in a combustion system, comprising:

sensing fuel flow to the combustion system;

sensing parameters representative of an oxygen demand value of the fuel in the combustion system, including at least one selected from thermal conductivity and specific heat parameters;

determining the oxygen demand value based on the sensed parameters;

sensing combustion air flow in the combustion system;

determining the actual fuel-to-air ratio as a function of the fuel flow, the oxygen demand value of fuel and the air flow sensed; and controlling the fuel-to-air ratio.

27. The method of claim 26 wherein the fuel-to-air ratio is controlled to a pre-selected fuel-to-air ratio set point.

28. The method of claim 27 wherein the fuel-to-air ratio is controlled to a pre-selected excess air set point.

29. The method of claim 26 wherein the step of sensing parameters representative of the oxygen demand value of the fuel further comprises:

sensing thermal conductivity of the fuel; and sensing specific heat of the fuel.

30. The method of claim 29 wherein the step of determining the oxygen demand value further comprises:

determining the oxygen demand value of the fuel based on the thermal conductivity and the specific heat of the fuel.

31. The method of claim 30, wherein the oxygen demand value determining step further comprises:

receiving from a sensor in the fuel flow stream a data signal encoding first and second thermal conductivity values $f_1(x)$ and $f_2(x)$ respectively of at least a first gaseous fuel at first and second different temperatures respectively;

recording the first and second thermal conductivity values;

receiving from a sensor in the fuel flow stream a data signal encoding a specific heat value $f_3(x)$ of at least the first gaseous fuel;

recording the specific heat value;

receiving a data signal encoding polynomial coefficient values $A_1$, $A_2$, $A_3$, and exponent values n1, n2, and n3;

recording the polynomial coefficient values;

retrieving the recorded first and second thermal conductivity values, the specific heat value, and the polynomial coefficient values and computing the oxygen demand value $D_f = A_1f_1^{n1}(x)\cdot A_2f_2^{n2}(x)\cdot A_3f_3^{n3}(x)$; and recording the oxygen demand value $D_f$.

32. The method of claim 26 and further comprising:

sensing average air composition of the air in the combustion system.

33. The method of claim 32 wherein the step of sensing air composition comprises:

sensing oxygen content of the air in the heating system; and sensing moisture content of the air in the heating system.

34. The method of claim 26 wherein the step of sensing fuel flow comprises:

sensing volumetric flow of the fuel;

determining correction factors for the volumetric flow based on specific heat and thermal conductivity; and determining a corrected volumetric flow for the fuel based on the correction factors and the sensed mass flow.

35. The method of claim 26 wherein the step of sensing fuel flow comprises:

sensing mass flow of the fuel;

determining correction factors for the mass flow based on specific heat and thermal conductivity; and determining a corrected mass flow for the fuel based on the correction factors and the sensed mass flow.

36. The method of claim 26 wherein the step of sensing combustion air flow comprises:

sensing volumetric flow of the combustion air;

determining correction factors for the combustion air volumetric flow based on specific heat and thermal conductivity; and determining a corrected volumetric flow for the combustion air based on the correction factors and the sensed volumetric flow.

37. The method of claim 26 wherein the step of sensing combustion air flow comprises:

sensing mass flow of the combustion air;

determining correction factors for the mass flow of combustion air based on specific heat and thermal conductivity; and determining a corrected mass flow for the combustion air based on the correction factors and the sensed mass flow.

* * * * *